US010555654B2

(12) United States Patent
Cornelissen

(10) Patent No.: US 10,555,654 B2
(45) Date of Patent: Feb. 11, 2020

(54) SUCTION NOZZLE FOR A VACUUM CLEANER

(71) Applicant: Vorwerk & Co. Interholding GmbH, Wuppertal (DE)

(72) Inventor: Markus Cornelissen, Bornheim (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 0 days.

(21) Appl. No.: 15/575,012

(22) PCT Filed: Jun. 3, 2016

(86) PCT No.: PCT/EP2016/062629
§ 371 (c)(1),
(2) Date: Nov. 17, 2017

(87) PCT Pub. No.: WO2016/202610
PCT Pub. Date: Dec. 22, 2016

(65) Prior Publication Data

US 2018/0146832 A1 May 31, 2018

(30) Foreign Application Priority Data

Jun. 19, 2015 (DE) ..... 10 2015 109 838

(51) Int. Cl.
*A47L 9/28* (2006.01)
*A47L 9/02* (2006.01)
*A47L 5/28* (2006.01)

(52) U.S. Cl.
CPC ..... *A47L 9/2842* (2013.01); *A47L 5/28* (2013.01); *A47L 9/02* (2013.01); *A47L 9/2805* (2013.01)

(58) Field of Classification Search
CPC ..... A47L 9/2842; A47L 9/2805; A47L 5/28; A47L 9/02; A47L 9/28; A47L 9/0633; A47L 9/06
See application file for complete search history.

(56) References Cited

U.S. PATENT DOCUMENTS 8,732,903 B2 5/2014 Splinter
2012/0000033 A1* 1/2012 Conrad ..... A47L 5/28 15/415.1

FOREIGN PATENT DOCUMENTS

WO 2007/074035 A1 7/2007
WO 2008/078238 A1 7/2008
WO 2009/128762 A1 10/2009

OTHER PUBLICATIONS

International Search Report of PCT/EP2016/062629, dated Jul. 21, 2016.

* cited by examiner

*Primary Examiner* — David Redding
(74) *Attorney, Agent, or Firm* — Collard & Roe, P.C.

(57) ABSTRACT

A suction nozzle for a vacuum cleaner has: a suction mouth which can be arranged adjacently to the surface to be cleaned and which comprises a suction edge that delimits a sub-surface exposed to the vacuum air stream; a vacuum air stream extraction opening; and a delimiter that can be controlled according to a detection result of a sensor. The sensor is an obstacle sensor for detecting a substantially stationary obstacle located in front of the suction nozzle, in particular a wall or piece of furniture, wherein the obstacle sensor is configured to detect obstacles that are disposed outside the portion of the surface over which the suction nozzle projects and, in relation to an arrangement of the suction nozzle during typical cleaning operation, that protrude beyond a suction edge plane that has the suction edge.

7 Claims, 4 Drawing Sheets

SUCTION NOZZLE FOR A VACUUM CLEANER

CROSS REFERENCE TO RELATED APPLICATIONS

This application is the National Stage of PCT/EP2016/062629 filed on Jun. 3, 2016, which claims priority under 35 U.S.C. § 119 of German Application No. 10 2015 109 838.5 filed on Jun. 19, 2015, the disclosures of which are incorporated by reference. The international application under PCT article 21(2) was not published in English.

TECHNICAL FIELD

The invention pertains to a suction nozzle for a vacuum cleaner for vacuuming up material from a surface to be cleaned by means of a vacuum air flow, wherein the suction nozzle has a suction mouth, which can be arranged adjacent to the surface to be cleaned and features a suction edge that defines a partial surface exposed to the vacuum air flow and a vacuum air flow extraction opening, as well as a delimiting means that is assigned to the suction edge and can be controlled in dependence on the detection result of a sensor, wherein the sensor is an obstacle sensor for detecting an obstacle located in front of the suction nozzle, wherein the obstacle sensor is designed for detecting obstacles, which are arranged outside the part of the surface covered by the suction nozzle and protrude beyond a suction edge plane containing the suction edge referred to the arrangement of the suction nozzle (2) during a normal cleaning process, and wherein a first suction edge section of the suction edge features a first delimiting means and a second suction edge, section of the suction edge features a second delimiting means.

PRIOR ART

Suction nozzles of the above-described type are sufficiently known from the prior art. For example, publication WO 2007/074035 A1 discloses a suction nozzle for vacuuming up material, which features a vertically movable delimiting means on its front referred to the normal forward stroke direction. This suction nozzle features a sensor that is directed at the surface to be cleaned and serves for deterthining a dimensional characteristic of the material to be vacuumed up, wherein the delimiting means can be actively raised or lowered in dependence on the dimensional characteristic of the material to be vacuumed up, which is determined by the sensor. Publication WO 2008/078238 A1 discloses a suction nozzle with multiple delimiting means, in which all delimiting means are either displaced into a raised position or all delimiting means are lowered into a position on the surface or a leading delimiting means referred to the forward direction is displaced into a raised position while the other delimiting means remains in a position on the floor. Publication WO 2009/128762 A1 discloses a suction nozzle with adjustable delimiting means. The adjustable delimiting means consist of additional brushes that can be displaced by means of a button.

SUMMARY OF THE INVENTION

The invention is based on the objective of developing a suction nozzle, the delimiting means of which can be variably displaced when other events occur. This should make it possible, in particular, to adapt the suction characteristics to different events and/or cleaning tasks.

In order to attain this objective, the invention proposes that the delimiting means can be displaced independently of one another in opposite directions in dependence on the detection result of an obstacle sensor or multiple obstacle sensors.

The suction nozzle is equipped with an obstacle sensor that can detect an obstacle, which essentially extends vertically upward from the surface to be cleaned, e.g. a wall, a baseboard, a piece of furniture or the like. In this case, the obstacle sensor is advantageously arranged such that its detection zone lies outside the part of the surface to be cleaned, which is covered by the suction nozzle. In this way, the obstacle sensor detects obstacles lying outside the suction nozzle, particularly in front of the suction nozzle referred to the moving direction. The delimiting means may consist of a sealing lip, a bristle strip or the like, but may also be formed by a vacuum channel that is completely switched on or off in dependence on the detection result of the obstacle sensor. When the suction nozzle laterally approaches an obstacle, it would be conceivable, for example, to release a vacuum channel, which was up to this point not fluidically connected to the vacuum air flow extraction opening, wherein the end region of said vacuum channel on the suction nozzle leads into the region of the surface to be cleaned and is aligned in such a way that the region between the surface and the obstacle rising vertically therefrom can be purposefully vacuumed out. A first suction edge section of the suction edge features a first delimiting means and a second suction edge section of the suction edge features a second delimiting means, wherein the delimiting means can be displaced independently of one another, particularly also in opposite directions, in dependence on the detection result of an obstacle sensor or multiple obstacle sensors. The suction edge is therefore divided into a plurality of suction edge sections that can be respectively displaced independently of the other suction edge sections. In this case, each suction edge section may be provided with a separate obstacle sensor, which only monitors the region in front of the respective suction edge section for the presence of obstacles. It would alternatively also be conceivable to provide a common obstacle sensor for multiple suction edge sections, wherein the detection zone of this common obstacle sensor covers multiple suction edge sections and a certain suction edge section is assigned to each segment of the detection zone. The obstacle sensor may consist, for example, of a conventional camera chip, the pixels of which can be evaluated in defined sections. This allows an optimal assignment of an obstacle to a certain suction edge section, whereupon the delimiting means assigned to this suction edge section can be displaced. In this context, it is particularly advantageous that the delimiting means of different suction edge sections can also be displaced in opposite directions. The delimiting means of a suction edge section, in front of which an obstacle was detected, can thereby be raised while the delimiting means of all other suction edge sections of the suction nozzle are simultaneously moved toward the surface to be cleaned. This particularly applies as long as no obstacle is detected in front of these other suction edge sections. In this way, the suction power can be concentrated on the region in the front of the suction edge section, in the region of which the obstacle is located. If all delimiting means with the exception of the raised delimiting means completely rest on the surface to be cleaned, it is important that the suction mouth is not completely sealed off from the ambient air of the suction nozzle because the suction nozzle could otherwise attach itself to the surface to be cleaned. In fact, it has to be ensured that secondary air can enter the suction mouth. This is advantageously achieved in that at least a few of the delimiting means are realized in the form of air-permeable bristle strips, through which a certain air flow can pass.

In this context, it is particularly advantageous to divide the suction edge into multiple suction edge sections, which respectively feature delimiting means that can be displaced independently of one another. The presence of obstacles can be detected in front of each of these suction edge sections and the corresponding delimiting means can be raised. In this way, material to be vacuumed up, particularly coarse material, can be pushed in front of the delimiting means until the suction nozzle reaches a certain distance from an obstacle. As soon as the distance between the suction nozzle and the obstacle falls short of a defined minimum distance (threshold distance), the delimiting means of the corresponding suction edge section, in front of which the obstacle lies, is respectively lifted off or moved farther away from the surface to be cleaned such that the material to be vacuumed up can reach the suction mouth. In this case, the invention utilizes the effect that a narrow elongate flow channel, in which the suction power of a fan assigned to the suction nozzle is focused on a certain volume, is formed between the suction nozzle and the obstacle such that coarse material lying in front of the suction nozzle also can also be very easily vacuumed into the suction mouth.

If the detected obstacle is narrower than the suction edge of the suction nozzle, only the delimiting means of the suction edge sections, which actually lie in front of the obstacle, are raised. Flow paths providing particularly high suction power can thereby be purposefully formed. This concerns situations, for example, in which the suction nozzle frontally approaches a projection on a wall that, however, does not extend over the entire width of the suction nozzle. This likewise concerns a furniture leg that only extends over part of the suction edge.

The displacement of the delimiting means can basically be realized in different ways. For example, one or more delimiting means can be lifted off the surface to be cleaned in a sliding fashion or pivoted away from the surface to be cleaned about a pivoting axis. As soon as the suction nozzle moves away from the detected obstacle again, the delimiting means is once again moved toward the surface to be cleaned. In this context, the delimiting means can either be moved toward the surface to be cleaned such that it rests thereon or only to such an extent that a correspondingly large flow path remains between the delimiting means and the surface to be cleaned.

It is proposed that at least one delimiting means can be displaced from a blocking state, in which it at least partially blocks a suction edge section of the suction edge, into an open state, in which it completely releases the suction edge section, and vice versa. The blocking state may be defined in that the delimiting means on the respective suction edge section is either in contact with the surface to be cleaned or that the delimiting means is spaced apart from the surface to be cleaned by a certain distance such that a flow path to the vacuum air flow extraction opening still exists. In the blocking state, in which the corresponding suction edge section is only partially blocked, material to be vacuumed up, particularly also smaller coarse material such as small plant leaves or the like, can also reach the suction mouth in the blocking state, i.e. during a normal cleaning process of the suction nozzle without the presence of an obstacle. Only particularly large coarse material, e.g. large plant leaves or the like, are pushed in front of the suction edge section.

It is proposed that the delimiting means cannot be displaced into the open state until the distance between the suction nozzle and the obstacle falls short of a defined threshold distance, particularly a threshold distance of less than 50 mm, preferably less than 15 mm. An evaluation and control unit, which is connected to the obstacle sensor via a communication link, therefore does not evaluate an obstacle detected by the obstacle sensor as a reason for displacing the delimiting means of the respective suction edge section or the respective suction edge sections until the distance between the suction nozzle and the obstacle falls short of this threshold distance. As long as the distance between the suction nozzle and the obstacle is greater than this threshold distance, the evaluation and control unit determines that no requirements for a displacement of the corresponding delimiting means currently exist based on the evaluation of the detection results of the obstacle sensor and the delimiting means remains in its previous state. The threshold distance may be defined in dependence on the suction power of the suction fan assigned to the suction nozzle or the geometric circumstances of the suction nozzle. With respect to conventional suction nozzles and suction fans for vacuum cleaners, it is particularly advantageous if the threshold distance is smaller than 50 mm, preferably smaller than 15 mm or even smaller than 10 mm. In this way, the obstacle sensor of the suction nozzle detects an approaching baseboard, for example once the distance between the suction nozzle and the baseboard falls short of a threshold distance of 15 mm, and displaces the nearest delimiting means in order to release a flow path between, the respective delimiting means and the surface to be cleaned.

It is proposed that a first suction edge section is essentially aligned perpendicular to a normal moving direction of the suction nozzle and a second suction edge section is essentially aligned parallel to this moving direction. The suction edge therefore has suction edge sections that are oriented perpendicular to one another. In this case, a first suction edge section extends perpendicular to a normal moving direction of the suction nozzle, i.e. this first suction edge section is pushed in front of the suction mouth referred to a normal forward stroke of the suction nozzle. In this context, the forward stroke refers to a moving direction, in which a user pushes the vacuum cleaner away from himself/herself. Lateral second suction edge sections are furthermore provided and essentially aligned parallel to the moving direction. These suction edge sections can be used, in particular, for advantageously vacuuming up dust from cracks, e.g. at transitions between floors and walls.

The obstacle sensor may consist of an acoustic or optical sensor, particularly an ultrasonic sensor, a radar sensor or a laser distance meter. The measuring plane of this sensor lies essentially parallel to a plane defined by the suction edge and advantageously also within a conventional height range of baseboards such that the presence of a baseboard can be detected. In addition to optical and acoustic sensors, it is furthermore possible to use electromagnetic sensors, wherein a corresponding sensor may detect, e.g., a magnetic field change or a capacitance change due to the presence of an obstacle.

It is furthermore proposed that the suction nozzle features at least one cleaning element, particularly a bristle element, which can be displaced relative to the remaining parts of the suction nozzle in dependence on the detection result of the obstacle sensor. The cleaning element particularly may serve for cleaning an obstacle extending perpendicular to the surface to be cleaned. The cleaning element can be advantageously extended out of the housing of the suction nozzle and/or braced by the housing. Consequently, the detection result of the obstacle sensor is also be used for evaluating the approach of the suction nozzle to an obstacle, e.g. a baseboard, as a reason for extending cleaning elements, e.g. in the form of bristle elements, and for mechanically cleaning the obstacle. In order to clean baseboards, the bristle elements may be arranged, e.g., at a height of at least 1-10 cm from the surface to be cleaned and designed with bristles, the free end regions of which can be directed at the baseboard from above and/or from the side. As soon as the obstacle sensor detects that the threshold distance from the obstacle is exceeded again, i.e. that the suction nozzle has been moved away from the obstacle, the cleaning elements are once again retracted into the housing of the suction nozzle or displaced into an idle position, particularly after a predefined time period, such that the spatial dimensions of the suction nozzles are minimized again. This is advantageous because the cleaning elements would otherwise increase the horizontal and vertical dimensions of the suction nozzle and it could occur that the suction nozzle is higher than a clear furniture height such that cleaning underneath pieces of furniture would be impossible.

In addition to the above-described suction nozzle, the invention furthermore proposes a vacuum cleaner, particularly a hand-operated or automatically displaceable domestic floor vacuum cleaner, which serves for vacuuming up material from a surface to be cleaned by means of a vacuum air flow. According to the invention, this vacuum cleaner features an inventive suction nozzle.

The invention ultimately also proposes a method for vacuuming up material from a surface to be cleaned by means of a suction nozzle, which has a suction mouth that can be arranged adjacent to the surface to be cleaned and features a suction edge, wherein a delimiting means assigned to the suction edge is controlled in dependence on the detection result of a sensor, wherein the sensor in the form of an obstacle sensor detects the presence or absence of an essentially stationary obstacle, particularly a wall or a piece of furniture, in front of the suction nozzle outside the partial surface covered by the suction nozzle and beyond a suction edge plane containing the suction edge referred to the arrangement of the suction nozzle during a normal cleaning process, and wherein said sensor transmits the detection result to an evaluation and control unit, whereupon the evaluation and control unit actuates the delimiting means, particularly moves the delimiting means away from the surface to be cleaned and/or toward the surface to be cleaned. The obstacle sensor or obstacle sensors respectively detects or detect the presence or absence of an obstacle in the measuring plane continuously while the inventive method for vacuuming up material by means of the suction nozzle is carried out. In this case, the delimiting means assigned to the suction edge sections can either partially or completely blocked a flow path leading to the vacuum air flow extraction opening, particularly if no obstacle is currently detected, wherein the respective delimiting means is then displaced into an open state once an obstacle was detected in the region of the corresponding suction edge section. To this end, the delimiting means is lifted off or pivoted away from the surface to be cleaned such that the largest flow path possible into the suction mouth is released. In this context, it would also be possible to displace the delimiting means lying nearest to the obstacle into the open state and to place the remaining delimiting means, which do not lie in the region of an obstacle, on the surface to be cleaned in order to provide the highest suction power possible in the region of the obstacle.

It is furthermore proposed that at least one delimiting means at least partially blocks a suction edge section of the suction edge in the absence of an obstacle, wherein the delimiting means is moved farther from the surface to be cleaned as soon as the distance between an obstacle and the suction nozzle falls short of a defined threshold distance.

It is ultimately conceivable to lower the delimiting means of a suction edge section, in front of which no obstacle is detected, on the surface to be cleaned if an obstacle is detected in front of another suction edge section. This results in the above-described suction power increase in the region of the suction edge section, to which the obstacle is assigned.

BRIEF DESCRIPTION OF THE DRAWINGS

The invention is described in greater detail below with reference to exemplary embodiments. In the drawings.

DESCRIPTION OF THE EMBODIMENTS

Figure 1:
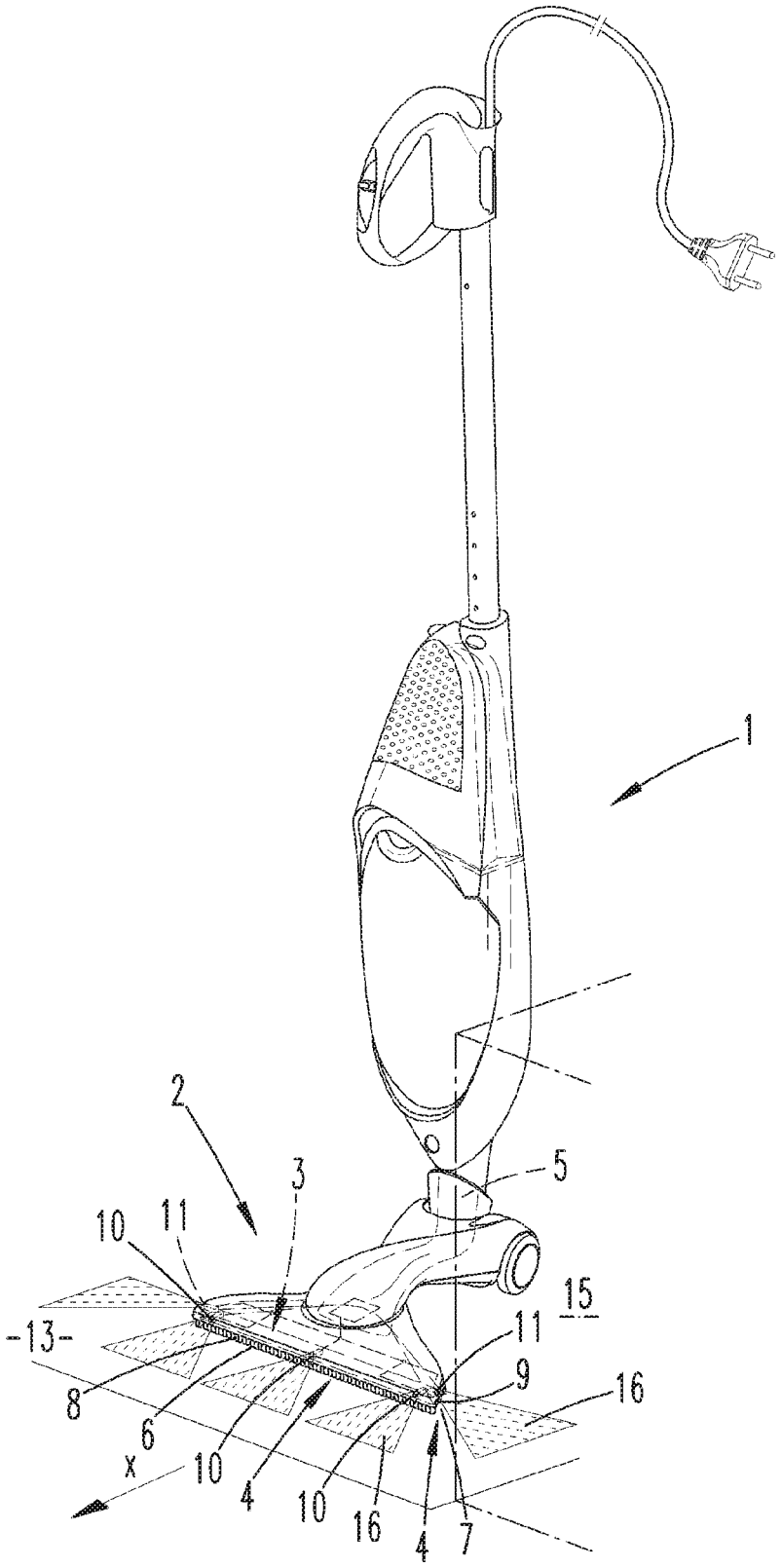
FIG. 1 shows an inventive vacuum cleaner with suction nozzle.

The vacuum cleaner 1 shown in FIG. 1 consists of a commercially available floor vacuum cleaner that features an inventive suction nozzle 2. The suction nozzle 2 has a suction mouth 3, the vacuum air flow extraction opening 5 of which is fluidically connected to a fan of the vacuum cleaner 1 via a corresponding channel. Material vacuumed up through the suction mouth 3 of the suction nozzle 2 are therefore transported through the vacuum air flow extraction opening 5 and into a filter chamber of the vacuum cleaner 1, which is normally provided, e.g., with a dust filter bag.

Figure 2:
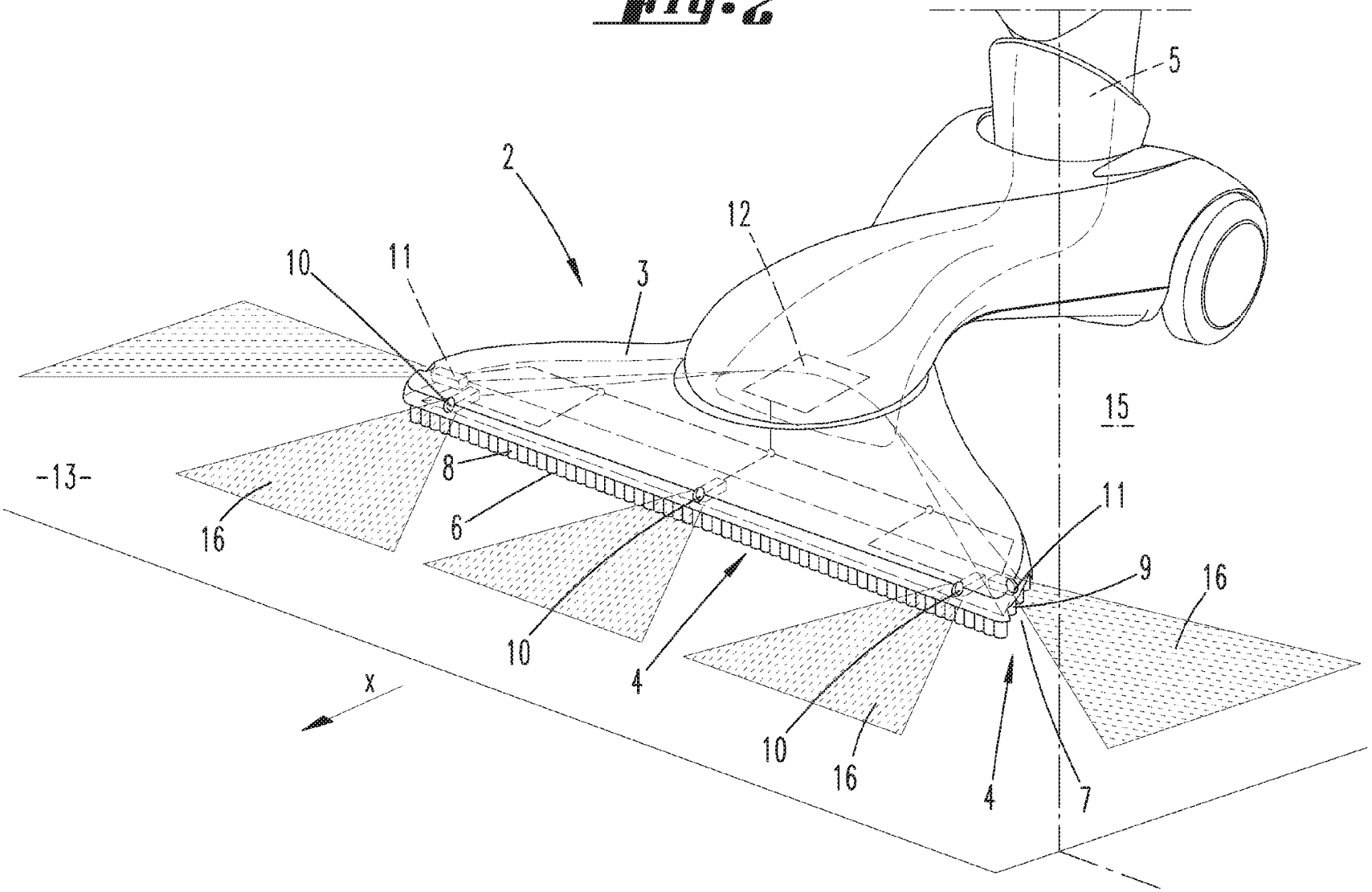
FIG. 2 shows the inventive suction nozzle in the form of a perspective view.

According to the detail in FIG. 2, the suction nozzle 2 has a suction mouth 3, the suction edge 4 of which defines the part of a surface 13 to be cleaned, which is acted upon with a vacuum. The suction edge 14 comprises a plurality of suction edge sections 6, 7, wherein a first suction edge section 6 is essentially aligned perpendicular to a normal moving direction x of the suction nozzle 2 and a second suction edge section 7 is essentially aligned parallel to the normal moving direction x of the suction nozzle 2. Additional suction edge sections are furthermore provided. The moving direction x results from the normal working motion of a user of the vacuum cleaner 1, which generally extends alternately forward and backward, if applicable, while swerving into the nearest cleaning path.

A separate delimiting means 8, 9 is assigned to each suction edge section 6, 7 and can be displaced from a blocking state into an open state and vice versa. In the blocking state, the delimiting means 8, 9 at least partially block the suction edge sections 6, 7 lying between the surface 13 to be cleaned and the housing of the suction nozzle 2. In this case, the delimiting means 8, 9 may be in direct contact with the surface 13 to be cleaned in a complete blocking state whereas a flow path from the suction edge section 6, 7 to the vacuum air flow extraction opening 5 remains open in a partial blocking state. In the open state, the delimiting means 8, 9 completely release the suction edge sections 6, 7 such that the largest vacuum air flow possible can reach the vacuum air flow extraction opening 5.

In this case, an obstacle sensor 10, 11 is assigned to each of the suction edge sections 6, 7 and monitors the respective detection zone 16 for the presence or absence of an obstacle 15. In this example, the obstacle 15 is a cabinet, which the suction nozzle 2 laterally approaches with the suction edge section 7.

The obstacle sensors 10, 11 of the suction nozzle 2 are realized in the form of ultrasonic sensors in this case. A common evaluation and control unit 12 is assigned to these obstacle sensors 10, 11, wherein said evaluation and control unit receives the detection results of the obstacle sensors 10, 11 and subsequently controls the displacement of the delimiting means 8, 9. The delimiting means 8, 9 are arranged within the housing of the suction nozzle 2 in a linearly displaceable fashion such that they can be vertically raised and lowered from the open state into the blocking state and vice versa. In this case, the delimiting means 8, 9 of the different suction edge sections 6, 7 can be displaced independently of one another such that one delimiting means 8 of a first suction edge section 6 can rest on the surface 13 to be cleaned while a delimiting means 9 of the second suction edge section 7 is spaced apart from the surface 13 to be cleaned such that a flow path from the second suction edge section 7 to the vacuum air flow extraction opening 5 is formed.

Figure 3:
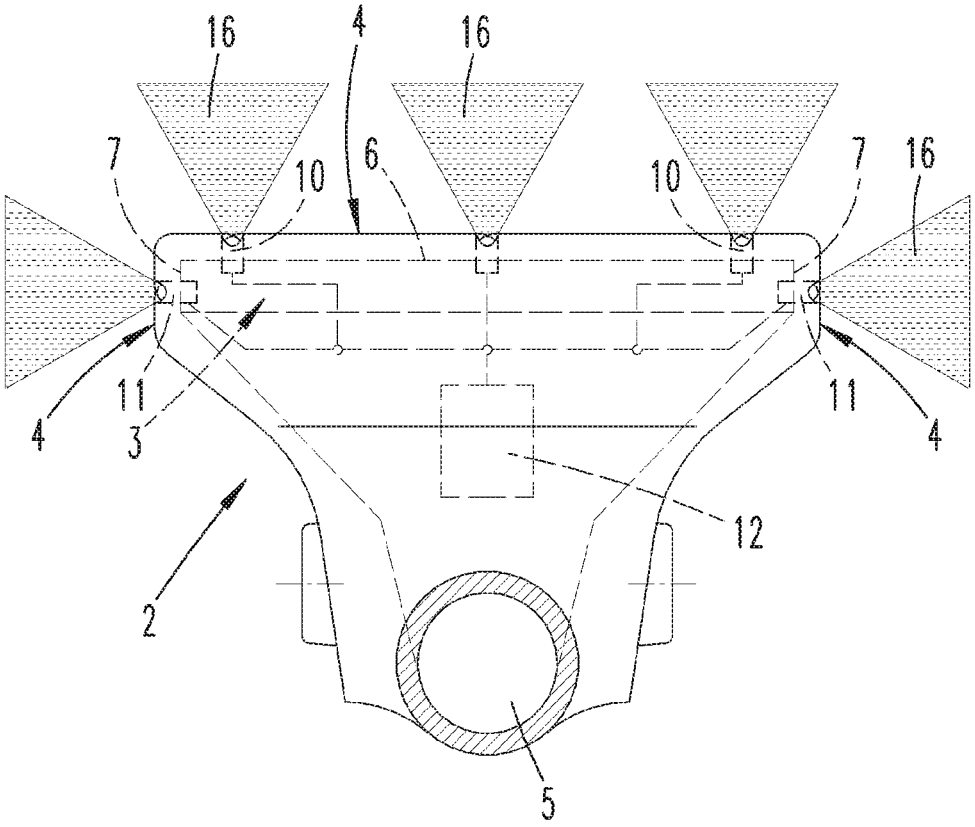
FIG. 3 shows the suction nozzle in the form of a top view.

FIG. 3 shows the suction nozzle 2 in the form of a top view, wherein the division of the suction edge 4 into multiple individual suction edge sections 6, 7 can be gathered from this figure. A separate delimiting means 8, 9 and a separate obstacle sensor 10, 11 are assigned to each suction edge section 6, 7, wherein said obstacle sensors respectively monitor a detection zone 16 lying in front of the respective suction edge section 6, 7.

Figure 4:
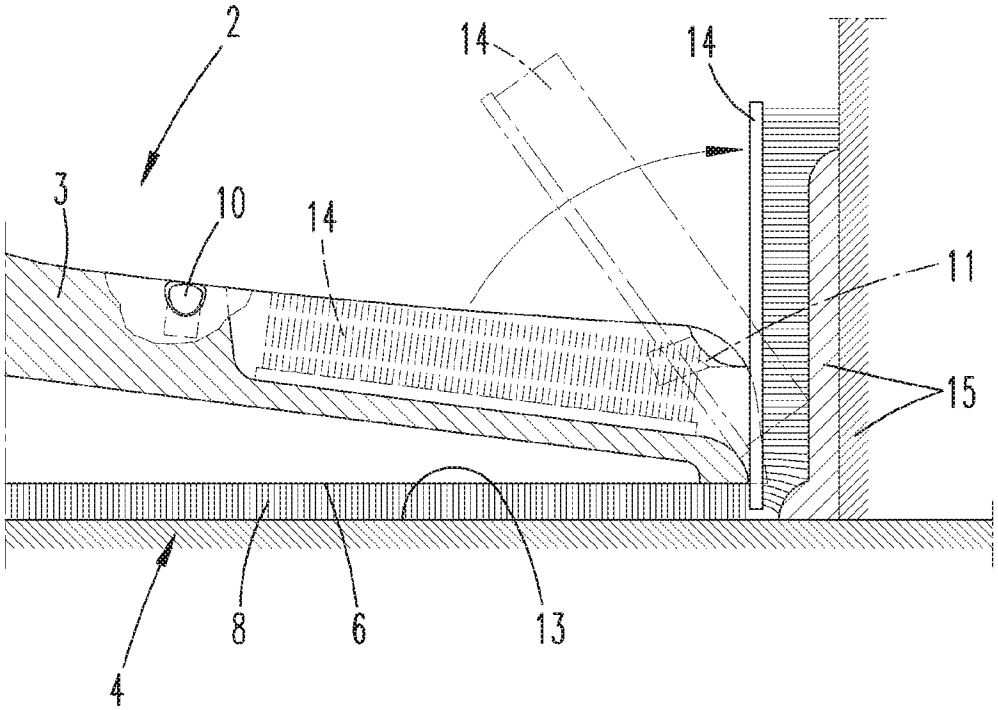
FIG. 4 shows part of a suction nozzle with cleaning elements for cleaning an obstacle.

FIG. 4 shows another embodiment of the suction nozzle 2 that features a cleaning element 14, namely a bristle element. The cleaning element 14 can be displaced relative to the housing of the suction nozzle 2 in dependence on the detection result of the obstacle sensor 10, 11, i.e. the presence of an obstacle 15. In this case, the cleaning element 14 may be arranged on the housing of the suction nozzle 2 such that it can be pivoted about a pivoting axis and displaced from a cleaning position into an idle position and vice versa, e.g. means of a servomotor.

According to the invention, the vacuum cleaner 1 is guided over the surface 13 to be cleaned with the suction nozzle 2. The obstacle sensors 10, 11 are operative during the cleaning process, i.e. soon as the suction fan of the vacuum cleaner 1 is switched on (or alternatively as soon as contact between the suction nozzle 2 and a surface 13 to be cleaned is detected) and detect the presence or absence of an obstacle 15 on the surface 13 to be cleaned in their respective detection zones 16. In this case, a normal position of the delimiting means 8, 9 of the suction nozzle 2 may be defined in that the frontally arranged delimiting means 8 referred to the forward stroke direction of the suction nozzle 2, as well as the lateral delimiting means 9 aligned parallel to the moving direction x, are in a blocking state on the suction edge sections 6, 7. In this blocking state, the delimiting means 8, 9 contact the surface 13 to be cleaned with their free end region. Since the delimiting means 8, 9 are realized in the form of bristle strips, fine material to be vacuumed up such as dust can still reach the suction mouth 3 of the suction nozzle 2 through the delimiting means 8, 9 such that the surface 13 to be cleaned can be vacuumed in a normal cleaning process.

During this cleaning process, the obstacle sensors 10, 11 continuously transmit their detection result to the evaluation and control unit 12, which compares the detection results with reference results stored in a data memory. The detection result of the obstacle sensors 10, 11 may consist, for example, of a measured distance from an obstacle 15. The stored reference result is a threshold distance that defines the distance between the suction nozzle 2 and an obstacle 15, at which a delimiting means 8, 9 lying nearest to the obstacle 15 is displaced into an open state. To this end, the evaluation and control unit 12 controls an actuator, e.g. a servomotor, assigned to the respective delimiting means 8, 9 in such a way that the delimiting means 8, 9 can be moved away from the surface 13 to be cleaned. As soon as the evaluation and control unit 12 determines that the detection results transmitted by the obstacle sensors 10, 11 once again indicate a distance that is greater than the threshold distance, the previously raised delimiting means 8, 9 is displaced back into the blocking state, in which it contacts the surface 13 to be cleaned. The evaluation and control unit 12 may, in principle, also take into account operating or sensor data of the vacuum cleaner 1 such that, for example, a displacement of the delimiting means 8, 9 is only possible when a minimum value for the suction power and/or the volumetric flow rate of a fan of the vacuum cleaner 1 is exceeded.

According to another embodiment, the delimiting means 8, 9 of the suction edge sections 6, 7 may be spaced apart from the surface 13 to be cleaned by a defined distance in a blocking state such that smaller coarse material can also reach the suction mouth 3 between the surface 13 to be cleaned and the delimiting means 8, 9. If one of the obstacle sensors 11 detects an obstacle 15, which is spaced apart from the suction nozzle 2 by a distance that is shorter than the threshold distance, the delimiting means 9 of the suction edge section 7 lying nearest to the obstacle is displaced into the open state such that a flow channel is formed between the obstacle 15 and the suction nozzle 2, wherein said flow channel concentrates the suction power of the suction fan on this flow channel and therefore allows optimal dust intake in front of the obstacle 15. The evaluation and control unit 12 simultaneously controls the other delimiting means 8 in such a way that they are placed on the surface 13 to be cleaned, wherein the remaining suction edge sections 6 are thereby blocked by the delimiting means 8 such that only fine material can reach the suction mouth 3 through these suction edge sections 6. This also applies to the opposite suction edge section 7, which is arranged parallel to the moving direction x. The delimiting means 9 arranged thereon is likewise placed on the surface 13 to be cleaned.

Other combinations of blocking states and open states of different delimiting means 8, 9 are also possible although these combinations are not discussed in greater detail in this application. For example, one or more delimiting means 8, 9 may be displaced into an open state while other delimiting means 8, 9 are in a partial blocking state, in which the delimiting means 8, 9 are also not placed on the surface 13 to be cleaned, but positioned near this surface.

According to the embodiment illustrated in FIG. 4, the suction nozzle 2 is also normally displaced over the surface 13 to be cleaned. In this case, the obstacle sensors 10, 11 monitor the detection zone 16 in front of the respectively assigned suction edge sections 6, 7 in the above-described fashion. As soon as the evaluation and control unit 12 detects that the suction nozzle 2 approaches an obstacle 15 based on a comparison between the detection results and defined threshold distances, the evaluation and control unit 12 controls the cleaning means 14, which lies nearest to the respective obstacle 15, in such a way that the cleaning element 14 is pivoted out of a housing section of the suction nozzle 2 and can be brought in contact with the obstacle 15. In this example, the cleaning element 14 consists of a bristle element, the bristles of which can brush over the obstacle 15, in this case a baseboard and part of a wall, with their free end regions. The cleaning element 14 is advantageously arranged directly adjacent to the respective suction edge section 6, 7 such that material to be vacuumed up, which is separated from the obstacle 15, can be immediately vacuumed into the suction mouth 3 through the opened suction edge section 6, 7. In this case, the cleaning elements 14 are shaped and dimensioned in such a way that the bristles are arranged at least approximately 1-10 cm from the surface 13 to be cleaned in order to thereby clean material to be vacuumed up from the horizontally extending edge of a baseboard. As soon as the obstacle sensor 10, 11 assigned to the corresponding suction edge section 6, 7 indicates that the threshold distance from the obstacle 15 has been exceeded, the cleaning element 14 is once again retracted into the housing of the suction nozzle 2 such that it no longer protrudes over the contour of the suction nozzle 2.

REFERENCE LIST

1 Vacuum cleaner
2 Suction nozzle
3 Suction mouth
4 Suction edge
5 Vacuum air flow extraction opening
6 Suction edge section
7 Suction edge section
8 Delimiting means
9 Delimiting means
10 Obstacle sensor
11 Obstacle sensor
12 Evaluation and control unit
13 Surface
14 Cleaning element
15 Obstacle
16 Detection zone
x Moving direction

The invention claimed is:

1. A suction nozzle for a vacuum cleaner for vacuuming up material from a surface to be cleaned by a vacuum air flow, comprising:

a suction mouth configured to be arranged adjacent to the surface to be cleaned and having a suction edge that defines a partial surface exposed to the vacuum air flow and a vacuum air flow extraction opening;

a delimiting means that is assigned to the suction edge;

an obstacle sensor configured for detecting an essentially stationary obstacle within a detection zone of the obstacle sensor, the obstacle being located in front of the suction nozzle and arranged outside a part of the surface covered by the suction nozzle and protruding beyond a suction edge plane containing the suction edge of the suction nozzle during a normal cleaning process, wherein the delimiting means is controlled by detection results of the obstacle sensor such that the delimiting means cannot be displaced into an open state until a detected distance between the suction nozzle and the obstacle is less than a defined threshold distance that is less than a possible maximum distance that is predetermined by the boundary of the detection zone, and wherein, in this way, material to be vacuumed up is pushed in front of the delimiting means until the suction nozzle reaches the threshold distance from the obstacle.

2. The suction nozzle according to claim 1, wherein the delimiting means is configured to be displaced from a blocking state, in which the delimiting means at least partially blocks a suction edge section of the suction edge, into an open state, in which the delimiting means completely releases the suction edge section, and vice versa.

3. The suction nozzle according to claim 1, wherein the delimiting means comprises a first delimiting means and a second delimiting means, wherein a first suction edge section of the suction edge features the first delimiting means and a second suction edge section of the suction edge features the second delimiting means, wherein the two delimiting means are configured to be displaced independently of one another, in dependence on the detection result of the obstacle sensor.

4. The suction nozzle according to claim 1, wherein the threshold distance is less than 50 mm.

5. The suction nozzle according to claim 1, wherein a first suction edge section is essentially aligned perpendicular to a normal moving direction (x) of the suction nozzle and a second suction edge section is essentially aligned parallel to the moving direction (x).

6. The suction nozzle according to claim 1, comprising at least one cleaning element that is configured to be displaced relative to the remaining parts of the suction nozzle in dependence on the detection result of the obstacle sensor, for cleaning an obstacle extending perpendicular to the surface to be cleaned.

7. A vacuum cleaner for vacuuming up material from a surface to be cleaned by means of a vacuum air flow, comprising a suction nozzle according to claim 1.

* * * * *